US007784119B2

(12) United States Patent
Booth et al.

(10) Patent No.: US 7,784,119 B2
(45) Date of Patent: Aug. 31, 2010

(54) ACCESS TO COMPONENTS OF WHIRLPOOL BATH AND AIR BUBBLER TUB SYSTEMS

(75) Inventors: John Booth, Coppell, TX (US); Michael C. Dinsdale, Richardson, TX (US)

(73) Assignee: Sanijet, Coppell, TX (US)

( * ) Notice: Subject to any disclaimer, the term of this patent is extended or adjusted under 35 U.S.C. 154(b) by 140 days.

(21) Appl. No.: 10/837,719

(22) Filed: May 3, 2004

(65) Prior Publication Data

US 2004/0216225 A1 Nov. 4, 2004

Related U.S. Application Data

(60) Provisional application No. 60/467,652, filed on May 2, 2003.

(51) Int. Cl.
*A61H 33/04* (2006.01)

(52) U.S. Cl. ..... 4/541.6; 4/507; 4/661

(58) Field of Classification Search ..... 4/496, 4/541.1–541.6, 507

See application file for complete search history.

(56) References Cited

U.S. PATENT DOCUMENTS

| | | | | |
|---|---|---|---|---|
| 2,269,748 | A | 1/1942 | Widman | |
| 4,290,154 | A | 9/1981 | Benjamin | |
| 4,780,917 | A * | 11/1988 | Hancock | 4/541.2 |
| 4,844,333 | A * | 7/1989 | Davis et al. | 4/541.1 |
| 4,903,351 | A * | 2/1990 | Dengel et al. | 4/507 |
| 5,245,221 | A * | 9/1993 | Schmidt et al. | 4/541.1 |
| 5,446,929 | A * | 9/1995 | Sills et al. | 4/557 |
| 5,515,557 | A | 5/1996 | Spurlin | |
| 5,587,023 | A | 12/1996 | Booth | |
| 5,864,898 | A | 2/1999 | Knapp | |
| 5,940,906 | A | 8/1999 | Halloran | |
| 6,269,494 | B1 | 8/2001 | Moretto | |
| 6,334,224 | B1 | 1/2002 | Chalberg | |
| 6,395,167 | B1 * | 5/2002 | Mattson et al. | 4/541.3 |
| 6,453,484 | B1 | 9/2002 | Pinciaro | |
| 6,523,192 | B1 | 2/2003 | Gloodt | |
| 6,578,208 | B1 * | 6/2003 | Lytle | 4/507 |
| 7,195,708 | B2 * | 3/2007 | Mullner, Jr. | 4/507 |

* cited by examiner

*Primary Examiner*—Tuan N Nguyen
(74) *Attorney, Agent, or Firm*—Phillip G. Meyers

(57) ABSTRACT

A hydromassage bathtub includes a bathtub including a sidewall, a deck, and an access opening in one of the sidewall and the deck. A fixture is secured to an outside surface of the bathtub proximate the access opening, and a removable plate configured to cover the access opening. A system component such as a control box is removably mounted on the fixture at a position whereby, upon removal of the plate, the system component can be removed from the fixture by accessing it through the access opening.

12 Claims, 4 Drawing Sheets

ACCESS TO COMPONENTS OF WHIRLPOOL BATH AND AIR BUBBLER TUB SYSTEMS

CROSS REFERENCE TO RELATED APPLICATIONS

This application claims the benefit of U.S. Provisional Application No. 60/467,652, filed May 2, 2003, which is hereby incorporated by reference in its entirety.

BACKGROUND OF THE INVENTION

A whirlpool bath is a jetted bathtub fitted with a system that circulates bath water to produce a hydro massage effect. Conventional whirlpool bath systems (piped systems), which have been on the market for over 30 years, circulate the water through a piping harness by means of a pump powered by an electric motor. Pipeless whirlpool bath systems, such as those recently developed by Sanijet Corporation, circulate the water using a series of unitized jet/suction devices each powered by a separate electric motor and operated by a single command pad through a set of electronic controls. Patents related to pipeless systems are U.S. Pat. Nos. 5,587,023, 5,414,878, and 4,853,987.

The system of an air bubbler tub consists of an air blower powered by an electric motor that forces air through hidden channels and/or false bottoms of the bathtub and then through holes into the bath water. Air bubbler systems do not circulate bath water, but create turbulence through injection of air into the bathwater.

All or substantially all components of conventional piped systems and air bubbler systems are hidden from view behind the bathtub and are not accessible for service from inside the bathtub through the sidewall or deck; without the present invention, access must be provided through an external or remote panel or removable tub skirt or enclosure. With a pipeless system, one can service the motors and jets through openings in the bathtub's sidewall into which the jets are installed without any other means of access; however, without the present invention, access to the electronic controls and components of the electrical wiring behind the bathtub requires an external or remote panel or removable tub skirt or enclosure.

Providing service access to whirlpool and air tub systems through an external or remote panel or removable tub skirt or enclosure is separate from the process of manufacturing the bathtub itself, is a matter of installation of the bathtub and is job site specific.

Thus, the present invention fulfills a need in the art by providing methods and compositions that overcome deficiencies in the art of whirlpool and air tub system service and maintenance.

BRIEF SUMMARY OF THE INVENTION

The invention relates to fill-and-drain whirlpool baths and other types of hydromassage bathtubs, such as air bubbler tubs, and provides access from inside the tub through the sidewall or deck of the tub to inspect, maintain, repair, replace, remove or upgrade (collectively "service") components of the water circulation system or forced air system of the bathtub. The present invention permits access to system components located behind the tub (e.g. electronic controls) from inside the bathtub through an opening in the sidewall or deck of the tub instead of through an external or remote panel or removable tub skirt or enclosure. A removable command pad or plate covers and seals the opening in the sidewall or deck of the tub. Removing the command or plate permits access through the opening to the components behind the sidewall of the tub. The invention makes access to system components an inherent characteristic of the bathtub itself regardless of installation parameters.

It is an object of the present invention to provide access to system components from the inside or "bathside" of the bathtub.

It is a further object of the present invention to provide access to system components through an opening in the sidewall or deck of the bathtub.

It is a further object of the present invention to provide a removable command pad or service plate as a means to seal the access opening to prevent the migration of moisture through the opening. The sealing mechanism may be part of the command pad/service plate, part of the sidewall of the tub, or provided separately in the form of a gasket, sealing ring or other means.

It is a further object of the present invention to simplify service access to system components without regard, for example, to installation or configuration of a room associated with the whirlpool bath or air bubbler tub.

It is a further object of the present invention to provide service access without an external panel or removable tub skirt or enclosure.

It is a further object of the present invention to render substantially all system components accessible through the tub's sidewall or deck.

It is a further object of the present invention to make service access to system components an inherent characteristic of the bathtub itself, independent of the bathtub's installation parameters.

To achieve the foregoing objects, one embodiment of the present invention is a hydromassage bathtub comprising an access opening in a wall of the bathtub; wherein the wall comprises a sidewall and a deck; a removable plate adapted to fasten to a bathside of the wall to cover the access opening; and one or more system components associated with a backside of the wall. In an additional embodiment, the hydromassage bathtub further comprises one or more mounting fixtures adapted to be located on the backside of the wall.

In an additional embodiment, the access opening is located in the sidewall. In an alternative embodiment, the access opening is located in the deck.

In an additional embodiment, the removable plate is a command pad having one or more electronic controls. In an additional embodiment, the removable plate further comprises a sealing mechanism.

In an additional embodiment, the one or more mounting fixtures are adapted to attach to the backside of the sidewall substantially adjacent to the access opening. In an additional embodiment, the one or more mounting fixtures are adapted to attach to the backside of the deck substantially adjacent to the access opening.

In an additional embodiment, the one or more mounting fixtures are adapted to be glued to the backside of the wall. In an additional embodiment, the one or more mounting fixtures are adapted to be fastened to the backside of the wall. In an additional embodiment, the removable plate is adapted to be mounted to the bathside of the wall by fastening to the one or more mounting fixtures.

In an additional embodiment, the one or more system components further comprise a control box and a junction box.

In an additional embodiment, the access opening is sized to allow service of the one or more system components. In an additional embodiment, no external remote panel is required for access to service system components. In an additional embodiment, no removable tub skirt or other enclosure is required for access to service system components.

In an alternate embodiment of the present invention, there is a method of access to system components of a whirlpool bath or air bubbler tub through the wall of the tub, comprising the steps of unfastening a removable plate fastened to the bathside of the tub that covers an access opening in the sidewall or deck of the tub, removing the plate, and accessing one or more system components associated with the backside of the tub.

In an additional embodiment, the method further comprises servicing one or more system components through the access opening in the bathtub.

In an additional embodiment, the method further comprises fastening the removable plate to cover the access opening in the bathtub and sealing the access opening to prevent the migration of moisture through the access opening.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
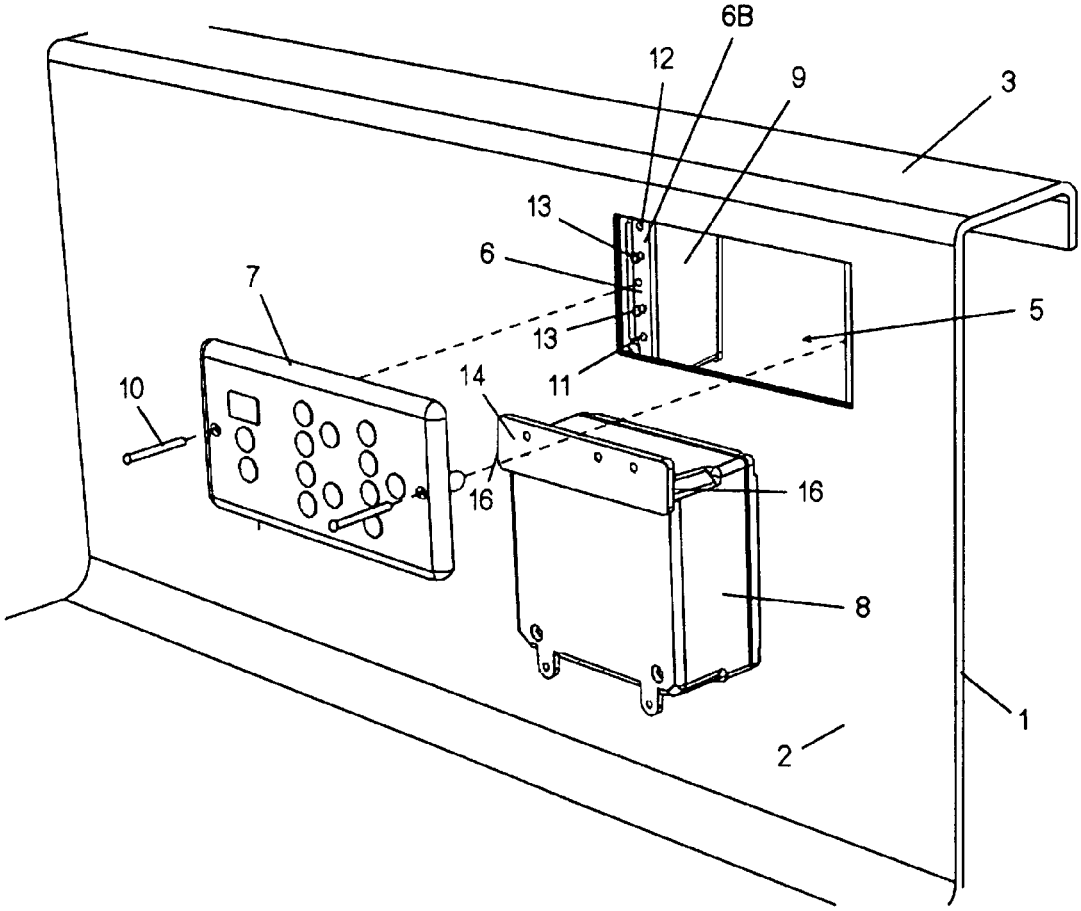
FIG. 1 is a cut-away view of a bathtub from the inside of the tub and exploded view of designated components and service opening in sidewall of tub.

The design and use of the invention are best understood by referring to FIGS. 1-4 of the drawings. Each part is identically numbered in each drawing. Patents related to the present invention include U.S. Pat. Nos. 5,587,023, 5,414,878, and 4,853,987 the disclosures of which are incorporated herein by reference.

DEFINITIONS AND USE OF TERMS

In the specification and in the claims which follow, reference will be made to a number of terms which shall be defined to have the following meanings:

It should be noted that, as used in the specification and the appended claims, the singular forms "a," "an" and "the" include the plural form as well unless the context clearly indicates otherwise. Thus, reference to "a system component" may include numerous system components, for example, a control box and a junction box, among other components. The terms "at least one," and "one or more" refer to the singular or the plural.

The term "service" or "servicing" means to inspect, remove, repair, replace, upgrade or maintain one or more components of the water circulation system of a whirlpool bath or forced air system of an air bubbler tub.

The terms "access opening" or simply "opening," as used herein, refers to any aperture, space, gap or hole in the sidewall or deck of the bathtub that may correspond in shape and size to the removable command pad or plate that covers and seals the opening. The access opening may vary in size or shape as necessary with regard for the desired application. The access opening provides a means of reaching and servicing system components hidden from view behind the bathtub and otherwise difficult or impossible to service without an external panel or removable tub skirt or enclosure. Furthermore, the access opening does not remain "open" in all stages of the invention. For example, when the whirlpool bath or air bubbler tub is being used, or when components behind the tub are not being serviced, the command pad/plate is fastened in place and sealing the access opening.

The term "substantially," as used herein, is a term of approximation, and means the same as or very close to that which is specified.

The term "sidewall" as used herein refers to wall of the bathtub between the bottom and top rim and is substantially vertical.

The term "deck" as used herein, refers to the substantially horizontal surface of the bathtub that encircles all or part of the top edge or rim of the tub and is substantially perpendicular to the sidewall.

The term "fasten" as used herein refers to joining, securing, connecting, integrating, or the like, items together or alternatively, joining, securing, connecting, integrating, or the like, a single item to itself.

The term "fastener," as used herein, refers to any object, mechanism, means or technique capable of securing an item to another item (e.g. control box to mounting fixture) and may include, for example, a slender, usually cylindrical piece of metal for holding or fastening parts together, screws, nuts and bolts, nails, pegs, wire (e.g., stiff or malleable), snapping fixtures or mechanisms and other types of fastening hardware or techniques.

The term "hydromassage bathtub," as used herein includes a whirlpool bath, an air bubbler tub, as defined herein, or any other type of hydromassage device or appliance.

The term "whirlpool bath," as used herein means a fill-and-drain (commonly drained after each use), jetted bathtub fitted with a system that circulates bath water to produce a hydro massage effect and encompasses all brands of such bathtubs. The name "Jacuzzi" is a brand of whirlpool bath but has also developed a secondary meaning in the marketplace to describe or refer to whirlpool baths generically (e.g. "jacuzzi tub" or simply "jacuzzi").

The term "air bubbler tub," as used herein means a bathtub fitted with a system consisting of an air blower powered by an electric motor that forces air through hidden channels and/or false bottoms built into the bathtub and then through holes into the bath water. Air bubbler tub systems do not circulate bath water, but create turbulence through injection of air into the bathwater.

The term "bathside," as used herein refers to all surfaces of a bathtub with which the user makes contact during normal bathing or when cleaning the tub, including, but not limited to, the bottom, sides and deck. The "bathside" is the inside part of the bathtub. Additionally, the "bathside" includes all surfaces of the bathtub with which water makes contact during use, and additionally includes all surfaces of built-in seating.

The term "backside," as used herein refers to the surfaces of a bathtub on most styles and models with which the user does not make contact during normal bathing or when cleaning the tub. The "backside" surfaces are the reverse sides of the "bathside" surfaces and include, but are limited to the side of the sidewalls and deck not visible on most styles and models when the bathtub is installed. The "backside" is the outside part of the bathtub.

The term "sealing mechanism," as used herein refers to a rubber, foam, caulk-like or other sealing material on the edge of or otherwise a part of the command pad or plate, or a rubber, foam, caulk-like or other sealing material on the surface or otherwise part of the sidewall of the tub, or provided separately from the command pad/plate and the sidewall by a gasket, sealing ring or other sealing device or means. The sealing mechanism functions to prevent the migration of moisture through the access opening.

The term "associated with," as used herein, refers to being mounted on, supported by or attached, fastened, joined, connected or otherwise secured to a surface or point of reference.

Referring to FIG. 1, a cut away view of a bathtub 1 from the inside or bathside of the bathtub and exploded view of designated components and service opening in sidewall 2 of bathtub 1 is shown. As shown in the embodiment shown in FIG. 1, there is an access opening 5 in the sidewall 2. The access opening 5 alternatively may be in the deck 3 of the bathtub. The size of the access opening 5 permits service of system components, such as the control box 8 or the junction box 9. Additionally, one or more mounting fixtures 6 are fastened to the bathtub 1 at or near the access opening 5 by means of glue, screws or other means. Fixture 6 includes a U-shaped inner plate 6*a* in contact with the outside of tub wall 2 and a pair of left and right outer plates 6*b*. Plates 6*b* overlap the sides of opening 5 and each presents a row of holes 12 in which screws can be mounted. A command pad/service plate 7 may be fastened to the mounting plates 6*b* by means of screws 10 which engage a pair of holes 12 on opposite sides of opening 5. Holes 12 are formed in portions of plates 6*b* of fixture 6 which extend under opening 5.

Figure 2:
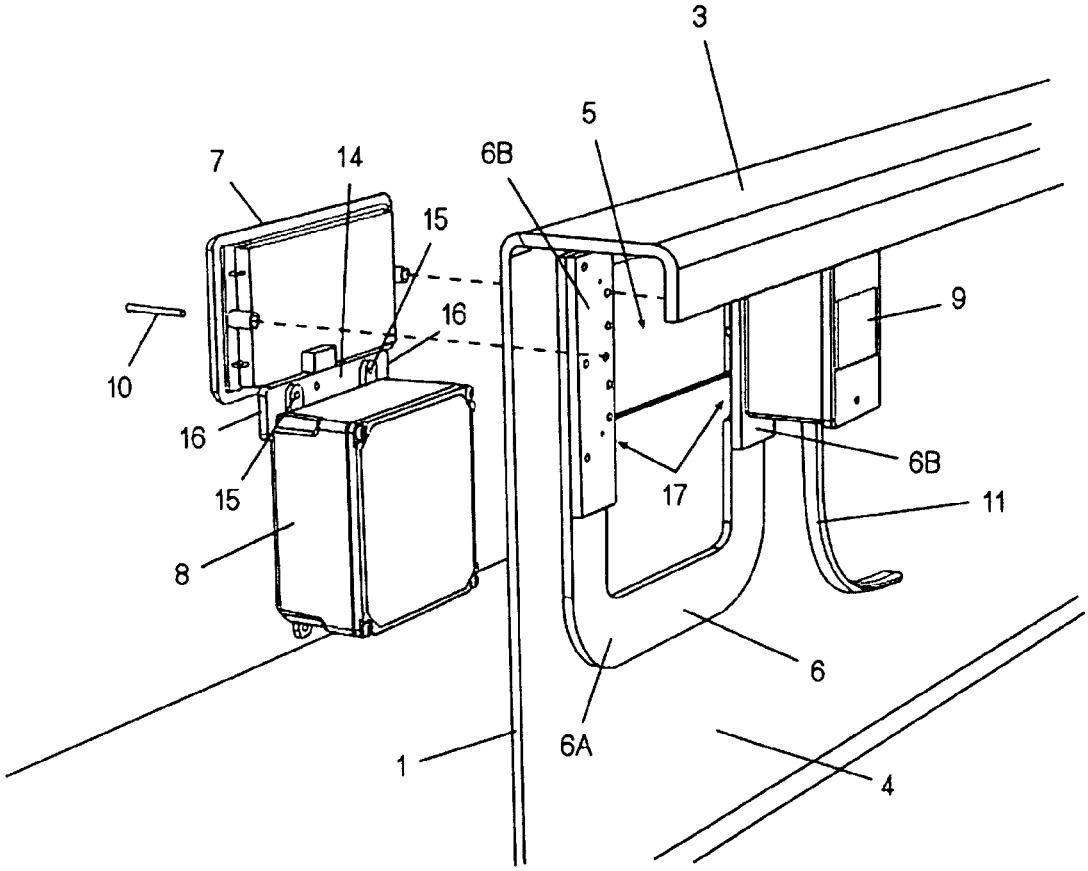
FIG. 2 is a cut-away view of a bathtub from the backside (outside) of the tub and exploded view of designated components and service opening in sidewall of tub.

Referring to FIG. 2, a cut away view of bathtub 1 from the backside or outside of the bathtub and exploded view of designated components and access opening 5 in sidewall 2 of bathtub 1 is shown. As shown in the embodiment shown in FIG. 2, the command pad/service plate 7 is fastened against the sidewall 1 or deck 3 of the bathtub in or over the opening 5 and secured to the mounting fixtures 6 by fasteners 10 to permit removal of the command pad/service plate 7, as well as permit service of system components such as, for example, the control box 8 and the junction box 9. As shown in the embodiment shown in FIG. 2, the control box 8 and the junction box 9 are secured to the mounting fixtures 6 on the backside of the tub. Junction box 9 may be secured to a pair of holes 12 by means of screws 13 on the left side of opening 5 as shown in FIG. 1. Control box 8 has a rectangular mounting bar 14 secured thereto along its upper front edge by screws set through a pair of mounting flanges 15. Bar 14 is longer than box 8 is wide so that its ends 16 protrude past the sides of box 8 as shown. Ends 16 of bar 13 slide into a pair of grooves 17 between fixture plates 6*a*, 6*b* extending along and below the bottom of opening 5 so that box 8 may be installed and removed from the inside of tub wall 2 through opening 5 by sliding ends 16 into and out of grooves 17.

During bathtub assembly, one or more of mounting fixtures 6 may be attached to the backside sidewall surface 4 or backside of deck 3 of the bathtub at or near the access opening 5 by means of glue, screws or other fastening means. System components including, but not limited to, the control box 8 and junction box 9 are fastened to the mounting fixture(s) 6 by screws, clips or other means that permit service of the components through the access opening 5. In some embodiments, the command pad/service plate 7 may be integrated with other components such as the control box 8 and/or junction box 9 into one component that would interface with the mounting fixture(s) 6 through the access opening 5.

Additionally, system components including, but not limited to, the control box 8, the junction box 9, as well as pumps, motors, piping, blowers, switches, electrical components, transformers, jets, electronic controls, wiring harnesses, essentially any and all ancillary components (not shown in FIG. 2) hidden from view on the backside of the tub may be serviced through the access opening 5 according to the present invention.

Figure 3:
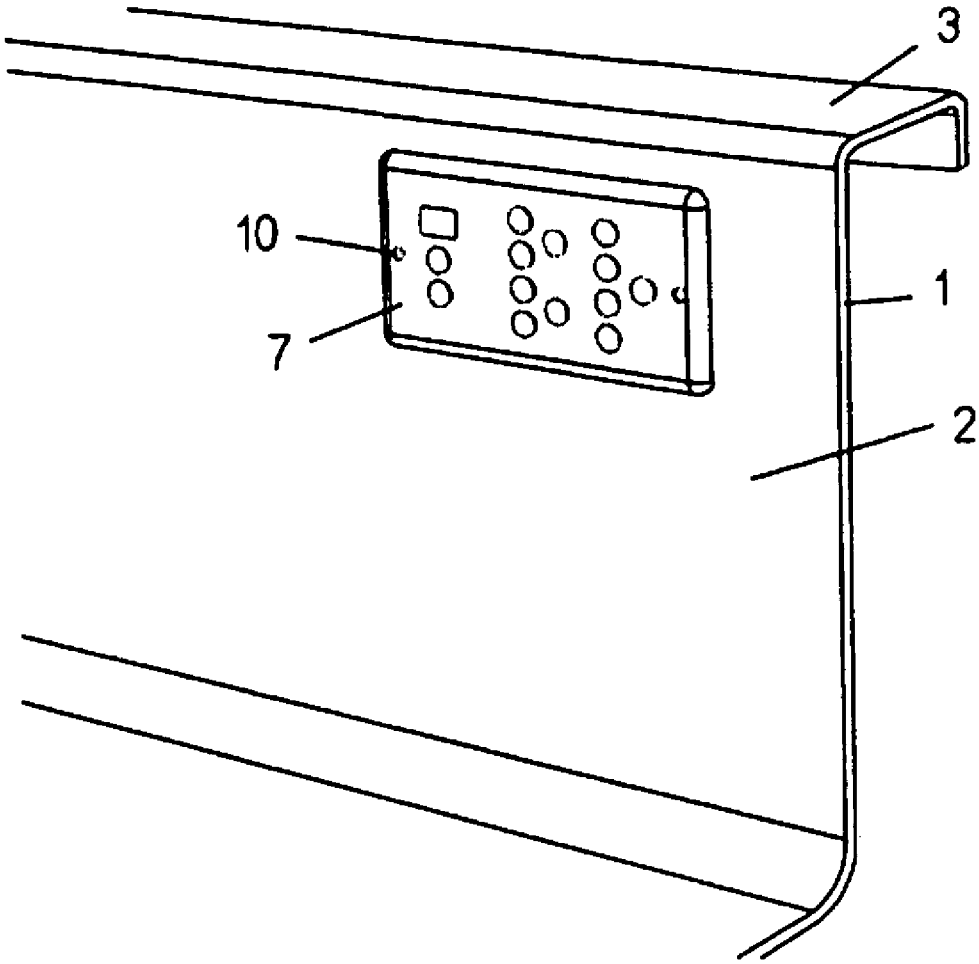
FIG. 3 is a cut-away view of a bathtub from inside the tub with command pad fastened in place.

Referring to FIG. 3, a cut-away view of a bathtub from inside the bathtub with command pad fastened in place is shown. As shown in the embodiment shown in FIG. 3, when fastened in place against the sidewall 1 or deck 3 of the tub, the command pad/service plate provides a seal around the access opening 5 to prevent migration of moisture through the access opening 5.

To service system components, one would remove the fasteners 10 or otherwise loosen and remove the command pad/service plate 7 and remove the one or more of the system components through the access opening 5. One would also disconnect electrical wiring 11 as necessary either before or after removing the part(s) as necessary. Through the access opening, one would make necessary repairs or replacements of parts, reconnect electrical wiring 11 as necessary and remount the parts involved. One could also replace or repair the command pad/service plate 7 as necessary. When finished, one would fasten the command pad/service plate 7 back in place with the fasteners 10, again sealing the access opening 5.

Figure 4:
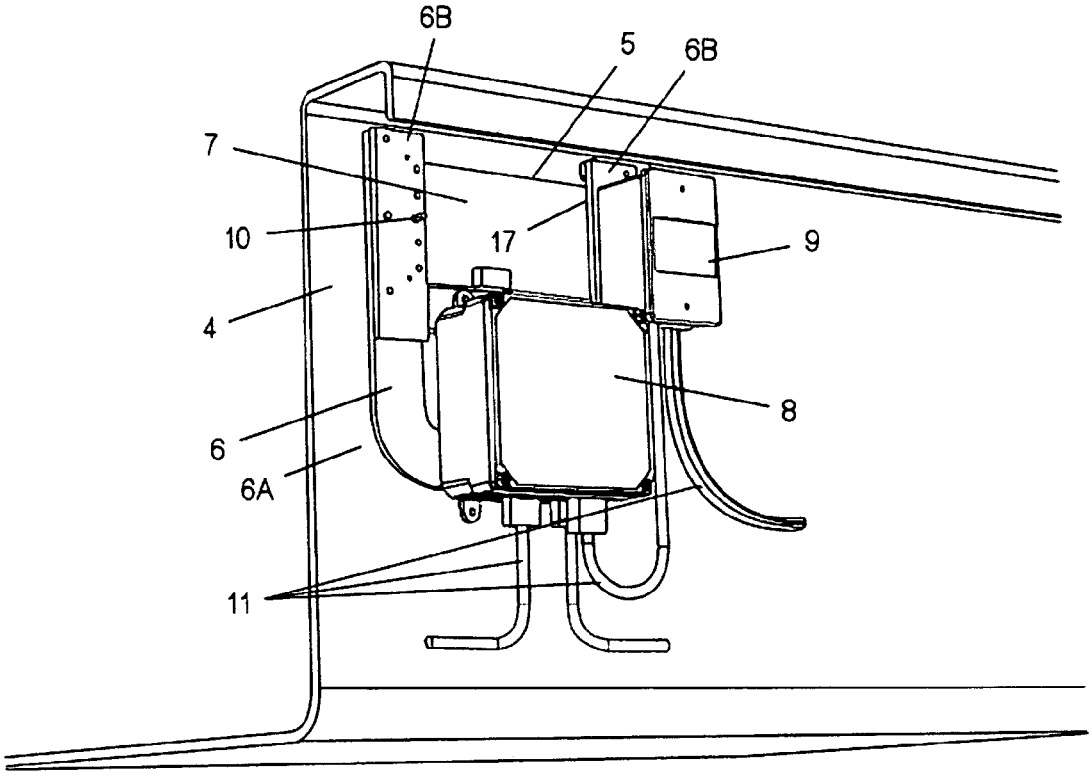
FIG. 4 is a cut-away view of a bathtub from the backside (outside) of the tub with control box, mounting plate, junction box, electrical wiring and backside of command pad fastened in place.

Referring to FIG. 4, a cut-away view of a bathtub from the backside (outside) of the bathtub with control box 8, mounting fixtures 6, junction box 9, electrical wiring 11 and command pad/service plate 7 fastened in place is shown.

As shown in the embodiment shown in FIG. 4, it would be readily recognized by one skilled in the field of whirlpool bathtubs that system components including, but not limited to, the control box 8 and the junction box 9 could be combined into a single box, which could be readily removable or serviced.

Thus, the invention provides access for service of one or more system components from inside the bathtub through the access opening rather than through an external or remote means of access now required for all or substantially all whirlpool bath and air bubbler tub systems, except for the motors and jets on a pipeless whirlpool bath system.

The present invention provides service access from inside the bathtub to all system components previously accessible only through external or remote access. Thus, the present invention can in many cases eliminate the need for any external means of access such as through a panel or removable bathtub skirt or enclosure. The need for external access to system components behind the bathtub places constraints on and increases the cost of site planning (e.g. bathroom layout) and installation. Therefore, by providing bathside access to system components, the present invention eliminates the need for external access in many cases, which provides greater freedom, flexibility and economy in site planning and installation.

Although the present invention and its advantages have been described in detail, it should be understood that various changes, substitutions and alterations can be made herein without departing from the invention as defined by the appended claims. Moreover, the scope of the present application is not intended to be limited to the particular embodiments of the process, machine, manufacture, composition of matter, means, methods and steps described in the specification. As one will readily appreciate from the disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A method of accessing an electrical system component of a hydromassage bathtub including a sidewall, a deck, and an access opening in one of the sidewall and the deck, the sidewall forming an inside surface of the bathtub which is the bathside configured for holding water therein, and an outside surface of the bathtub on the opposite side of the sidewall from the inside surface, and the deck comprises an extension of the sidewall such that an upwardly facing surface of the deck forms part of the inside surface of the bathtub and a downwardly facing surface of the deck forms part of the outside surface of the bathtub, a fixture secured to the outside surface of the bathtub proximate the access opening, a removable plate configured to cover the access opening, and a system component removably mounted on the fixture, comprising:

(a) removing the plate from the access opening;

(b) disengaging the system component from the fixture; and then (c) drawing the system component through the access opening into the inside of the bathtub, (d) servicing the system component;

(e) inserting the system component back through the access opening;

(f) replacing the system component on the fixture; and then (g) replacing the plate, wherein the removable plate is fastened and unfastened to an underlying portion of the fixture in steps (g) and (a), respectively, and wherein the access opening is located in the sidewall and the removable plate further comprises a watertight seal, and the mounting fixture in combination with the sidewall forms a pair of grooves along opposite sides of the access opening, which grooves are configured for sliding insertion and removal of a pair of projections on the system component in steps (b) and (f).

2. The method of claim 1, wherein the grooves extend beyond the access opening to form a retaining portion in which the projections of the system component are mechanically engaged to mount the system component on the fixture.

3. The method of claim 1 wherein the system component is at least one of a control box, a junction box, a pump, a motor, a blower, a switch, a transformer, an electronic control, and an electrical wiring harness.

4. A hydromassage bathtub including a sidewall, a deck, and an access opening in one of the sidewall and the deck, the sidewall forming an inside surface of the bathtub which is the bathside configured for holding water therein, and an outside surface of the bathtub on the opposite side of the sidewall from the inside surface, and the deck comprises an extension of the sidewall such that an upwardly facing surface of the deck forms part of the inside surface of the bathtub and a downwardly facing surface of the deck forms part of the outside surface of the bathtub;

a mounting fixture comprising a strip secured to the outside surface of the bathtub proximate but laterally offset from the access opening so that the access opening is not substantially obstructed by the mounting fixture;

a removable plate configured to cover the access opening and create a watertight seal over the access opening, which plate can be removed from the inside of the bathtub; and at least one electrically powered hydromassage bathtub system component removably mounted on the fixture at a position to one side of the access opening, leaving the access opening substantially uncovered by the system component, whereby, upon removal of the plate, the system component can be removed from the fixture by accessing it through the access opening and then drawing it through the access opening into the inside of the bathtub.

5. The bathtub of claim 4, wherein the access opening is rectangular and the fixture comprises a pair of strips in face to face contact with the outer surface of the bathtub on opposite sides of the access opening.

6. The bathtub of claim 4, wherein the system component includes a control box, and the fixture includes a strip extending laterally below the access opening having the control box secured thereto.

7. The bathtub of claim 4, wherein the access opening is rectangular and the system component has a width which is less than the width of the access opening.

8. The bathtub of claim 4, wherein the system component is one of a control box, a junction box, a pump, a motor, a blower, a switch, a transformer, and an electronic control.

9. The hydromassage bathtub of claim 4, wherein the system component comprises a control box and a junction box mounted on the fixture side by side.

10. The hydromassage bathtub of claim 4, further comprising means for securing the fixture to the outside wall of the bathtub.

11. A hydromassage bathtub including a sidewall, a deck, and an access opening in one of the sidewall and the deck, the sidewall forming an inside surface of the bathtub which is the bathside configured for holding water therein, and an outside surface of the bathtub on the opposite side of the sidewall from the inside surface, and the deck comprises an extension of the sidewall such that an upwardly facing surface of the deck forms part of the inside surface of the bathtub and a downwardly facing surface of the deck forms part of the outside surface of the bathtub;

a mounting fixture comprising a strip secured to the outside surface of the bathtub proximate but laterally offset from the access opening so that the access opening is not substantially obstructed by the mounting fixture;

a removable plate configured to cover the access opening and create a watertight seal over the access opening, which plate can be removed from the inside of the bathtub; and at least one electrically powered hydromassage bathtub system component removably mounted on the fixture at a position to one side of the access opening, leaving the access opening substantially uncovered by the system component, whereby, upon removal of the plate, the system component can be removed from the fixture by accessing it through the access opening and then drawing it through the access opening into the inside of the bathtub, wherein the removable plate further comprises a watertight seal, and the mounting fixture in combination with the sidewall forms a pair of grooves along opposite sides of the access opening, which grooves are configured for sliding insertion and removal of a pair of projections on the system component.

12. The hydromassage bathtub of claim 11, wherein the grooves extend beyond the access opening to form a retaining portion in which the projections of the system component are mechanically engaged to mount the system component on the fixture.

* * * * *